US012624530B2

(12) United States Patent
Horii et al.

(10) Patent No.: US 12,624,530 B2
(45) Date of Patent: May 12, 2026

(54) CONTROL VALVE AND WORKING MACHINE INCLUDING CONTROL VALVE

(71) Applicants: KUBOTA CORPORATION, Osaka (JP); KYB CORPORATION, Tokyo (JP)

(72) Inventors: Hiroshi Horii, Osaka (JP); Syunsuke Fukuda, Kanagawa (JP)

(73) Assignees: KUBOTA CORPORATION, Osaka (JP); KYB CORPORATION, Tokyo (JP)

( * ) Notice: Subject to any disclaimer, the term of this patent is extended or adjusted under 35 U.S.C. 154(b) by 15 days.

(21) Appl. No.: 18/741,365

(22) Filed: Jun. 12, 2024

(65) Prior Publication Data

US 2024/0328121 A1 Oct. 3, 2024

Related U.S. Application Data

(63) Continuation of application No. PCT/JP2022/042939, filed on Nov. 21, 2022.

(30) Foreign Application Priority Data

Dec. 20, 2021 (JP) ..... 2021-206180

(51) Int. Cl.
*E02F 9/22* (2006.01)

(52) U.S. Cl.
CPC ..... *E02F 9/2267* (2013.01); *E02F 9/2285* (2013.01)

(58) Field of Classification Search
CPC ..... E02F 9/2285; E02F 9/2267; E02F 9/22
See application file for complete search history.

(56) References Cited

FOREIGN PATENT DOCUMENTS

| | | | | |
|---|---|---|---|---|
| EP | 3 205 888 | A1 | | 8/2017 |
| JP | 2002-323168 | A | | 11/2002 |
| JP | 2003172310 | A | * | 6/2003 |
| JP | 2004-293735 | A | | 10/2004 |
| JP | 2006-207657 | A | | 8/2006 |
| JP | 2007255468 | A | * | 10/2007 |
| JP | 2016-075341 | A | | 5/2016 |

OTHER PUBLICATIONS

International Search Report dated Feb. 14, 2023 in International Bureau of WIPO Patent Application No. PCT/JP2022/042939 with an English translation thereof.

(Continued)

*Primary Examiner* — Nathaniel E Wiehe
*Assistant Examiner* — Daniel S Collins
(74) *Attorney, Agent, or Firm* — Greenblum & Bernstein, P.L.C.

(57) ABSTRACT

The control valve includes a valve body; a spool hole formed in the valve body; a spool slidably fitted in the spool hole; a pilot chamber into which a pilot fluid to actuate the spool is led; a discharge passage to discharge a hydraulic fluid to an outside of the valve body; a spiral groove to communicate with the discharge passage, the spiral groove being formed in a spiral shape on an outer periphery of the spool; and at least one axial groove to cause the pilot chamber and the spiral groove to communicate with each other, the axial groove being formed along an axial direction of the spool on an inner surface of the spool hole.

4 Claims, 12 Drawing Sheets

(56) References Cited

OTHER PUBLICATIONS

Written Opinion dated Feb. 14, 2023 in International Bureau of WIPO Patent Application No. PCT/JP2022/042939 with an English translation thereof.
Office Action dated Mar. 18, 2025 in Japanese family member application No. 2021-206180 with English language translation thereof.

* cited by examiner

CONTROL VALVE AND WORKING MACHINE INCLUDING CONTROL VALVE

CROSS REFERENCE TO RELATED APPLICATIONS

This application is a continuation application of International Application No. PCT/JP2022/042939, filed on Nov. 21, 2022, which claims the benefit of priority to Japanese Patent Application No. 2021-206180, filed on Dec. 20, 2021. The entire contents of each of these applications are hereby incorporated herein by reference.

BACKGROUND OF THE INVENTION

1. Field of the Invention

The present invention relates to a control valve and a working machine including the control valve.

2. Description of the Related Art

Conventionally, a control valve disclosed in Japanese Unexamined Patent Application Publication No. 2007-255468 is known.

The control valve disclosed in Japanese Unexamined Patent Application Publication No. 2007-255468 includes a valve body having formed therein an actuator port to which a hydraulic actuator can be connected and a discharge passage that discharges a hydraulic fluid returning via the actuator port to the outside. A spool hole is formed in the valve body, a spiral groove with a spiral shape is formed on an outer periphery of a spool slidably fitted in the spool hole, a pilot chamber into which a pilot fluid to actuate the spool is led is provided, and the pilot chamber and the discharge passage are configured to communicate with each other via the spiral groove when the spool moves by a predetermined amount from a neutral position with the pilot fluid led into the pilot chamber. Accordingly, the pilot fluid led into the pilot chamber partially leaks to the discharge passage via the spiral groove, and hence air accumulated in the pilot chamber is removed, and switching responsiveness of the spool is improved.

SUMMARY OF THE INVENTION

In the control valve disclosed in Japanese Unexamined Patent Application Publication No. 2007-255468, it is considered that the air removal amount (the amount of air remaining in the pilot chamber) varies. Specifically, since the spool is rotatable on the axis, for example, when the spool is assembled in, the position of an end portion of the spiral groove near the pilot chamber in the length direction (an inlet-side end portion of the pilot fluid) varies depending on the rotational position of the spool on the axis. Since air is accumulated in an upper portion of the pilot chamber, for example, when the inlet-side end portion of the spiral groove is located at a low position, air is hardly removed.

In view of the above problem, an object of the present invention is to provide a control valve capable of stably removing air and a working machine including the control valve.

Solution to Problem

A control valve according to one aspect of the present invention includes a valve body; a spool hole formed in the valve body; a spool slidably fitted in the spool hole; a pilot chamber into which a pilot fluid to actuate the spool is led; a discharge passage to discharge a hydraulic fluid to an outside of the valve body; a spiral groove to communicate with the discharge passage, the spiral groove being formed in a spiral shape on an outer periphery of the spool; and at least one axial groove to cause the pilot chamber and the spiral groove to communicate with each other, the axial groove being formed along an axial direction of the spool on an inner surface of the spool hole.

The pilot chamber may be adjacent to the spool hole in the axial direction of the spool, and the axial groove may be located above the spool, in a state in which the valve body is installed such that the spool extends in a horizontal direction.

The at least one axial groove may include a plurality of axial grooves formed around the spool.

A passage resistance of the spiral groove may be larger than a passage resistance of the axial groove.

The control valve may include a circumferential groove formed in a circumferential direction on the inner surface of the spool hole, the circumferential groove communicating with an end portion of the axial groove opposite to an end portion of the axial groove that communicates with the pilot chamber. The discharge passage may be located opposite to the axial groove with respect to the circumferential groove to be spaced apart from the circumferential groove, and the spiral groove may cause the circumferential groove and the discharge passage to communicate with each other.

The pilot chamber and the discharge passage may be blocked from each other when the spool is in a neutral position, and the pilot chamber and the discharge passage may communicate with each other via the axial groove and the spiral groove when the spool is moved by a predetermined amount from the neutral position with the pilot fluid led into the pilot chamber.

A working machine may include the above-described control valve.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
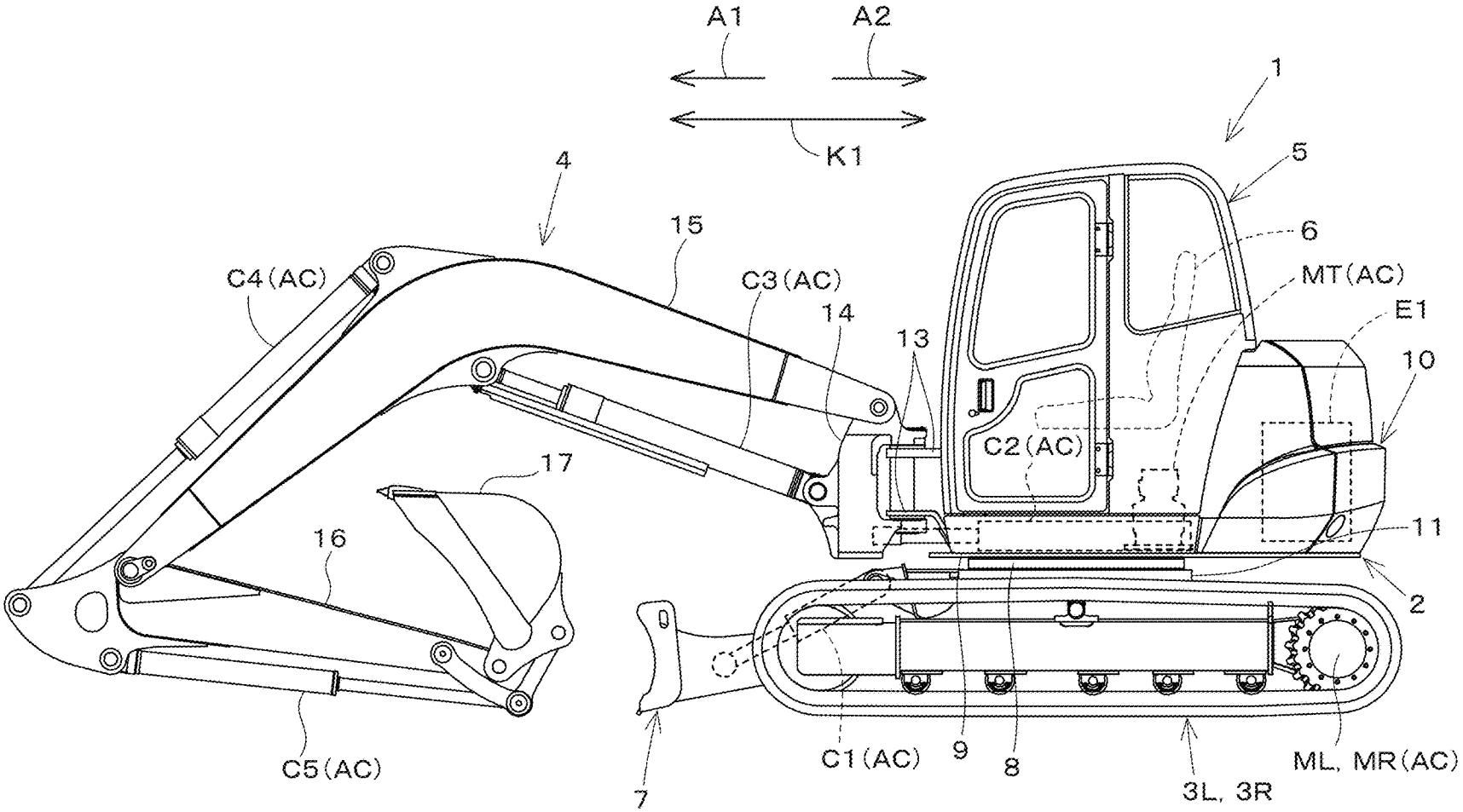
FIG. 1 is a side view of a working machine.

Example embodiments will now be described with reference to the accompanying drawings, wherein like reference numerals designate corresponding or identical elements throughout the various drawings. The drawings are to be viewed in an orientation in which the reference numerals are viewed correctly.

Hereinafter, one embodiment of the present invention will be described with reference to the drawings as appropriate.

FIG. 1 is a side view illustrating an overall configuration of a working machine 1. In the present embodiment, a backhoe, which is a turning working machine 1, is exemplified as the working machine 1.

As illustrated in FIG. 1, the working machine 1 includes a machine body (turning base) 2, a left traveling device 3L disposed on the left of the machine body 2, a right traveling device 3R disposed on the right of the machine body 2, and a working device 4 attached to a front portion of the machine body 2. A cabin 5 is mounted on the machine body 2. An operator's seat 6 on which an operator is seated is provided in a room of the cabin 5.

In the present embodiment, a direction in which the operator seated on the operator's seat 6 of the working machine 1 faces (a direction of arrow A1 in FIG. 1) is referred to as a forward side, and a direction opposite thereto (a direction of arrow A2 in FIG. 1) is referred to as a rearward side. Also, the left of the operator (near side in FIG. 1) is referred to as a leftward side, and the right of the operator (far side in FIG. 1) is referred to as a rightward side. Thus, a direction K1 in FIG. 1 is a front-rear direction (machine-body front-rear direction). Also, a horizontal direction that is a direction orthogonal to the front-rear direction K1 is referred to as a machine-body width direction.

In the present embodiment, the left traveling device 3L and the right traveling device 3R are constituted by crawler type traveling devices. The left traveling device 3L is driven by a traveling motor ML, and the right traveling device 3R is driven by a traveling motor MR. The traveling motors ML and MR are constituted by hydraulic motors (hydraulic actuators AC). A dozer device 7 is attached to a front portion of a traveling frame 11 to which the left traveling device 3L and the right traveling device 3R are attached. The dozer device 7 can be raised/lowered (a blade can be raised/lowered) by extending/contracting a dozer cylinder C1.

The machine body 2 is supported on the traveling frame 11 via a turning bearing 8 so as to be turnable about a vertical axis (an axis extending in an up-down direction). The machine body 2 is driven to turn by a turning motor MT constituted by a hydraulic motor (hydraulic actuator AC).

The machine body 2 includes a turning base plate 9 that turns about the vertical axis and a weight 10 supported on a rear portion of the turning base plate 9. The turning base plate 9 is formed of a steel sheet or the like, and is coupled to the turning bearing 8. A prime mover E1 is mounted in a rear portion of the machine body 2. The prime mover E1 is an engine. Note that the prime mover E1 may be an electric motor or of a hybrid type including an engine and an electric motor.

The machine body 2 includes a support bracket 13 at the front portion. A swing bracket 14 is attached to the support bracket 13 so as to be swingable about a vertical axis. The working device 4 is attached to the swing bracket 14.

The working device 4 includes a boom 15, an arm 16, and a bucket 17 as a working tool. A proximal portion of the boom 15 is pivotally attached to the swing bracket 14 so as to be rotatable about a horizontal axis (an axis extending in the machine-body width direction), and is swingable in the up-down direction. A proximal portion of the arm 16 is pivotally attached to a distal end portion of the boom 15 so as to be rotatable about a horizontal axis, and is swingable in the front-rear direction K1 or in the up-down direction. The bucket 17 is provided at a distal end portion of the arm 16 so as to be capable of performing shoveling and dumping. Instead of or in addition to the bucket 17, another working tool (hydraulic attachment) that can be driven by a hydraulic actuator AC can be attached to the working machine 1.

The swing bracket 14 is swingable by extension/contraction of a swing cylinder C2 provided in the machine body 2. The boom 15 is swingable by extension/contraction of a boom cylinder C3. The arm 16 is swingable by extension/contraction of an arm cylinder C4. The bucket 17 is capable of performing shoveling and dumping by extension/contraction of a bucket cylinder C5 as a working tool cylinder. The dozer cylinder C1, the swing cylinder C2, the boom cylinder C3, the arm cylinder C4, and the bucket cylinder C5 are constituted by hydraulic cylinders (hydraulic actuators AC).

Figure 2:
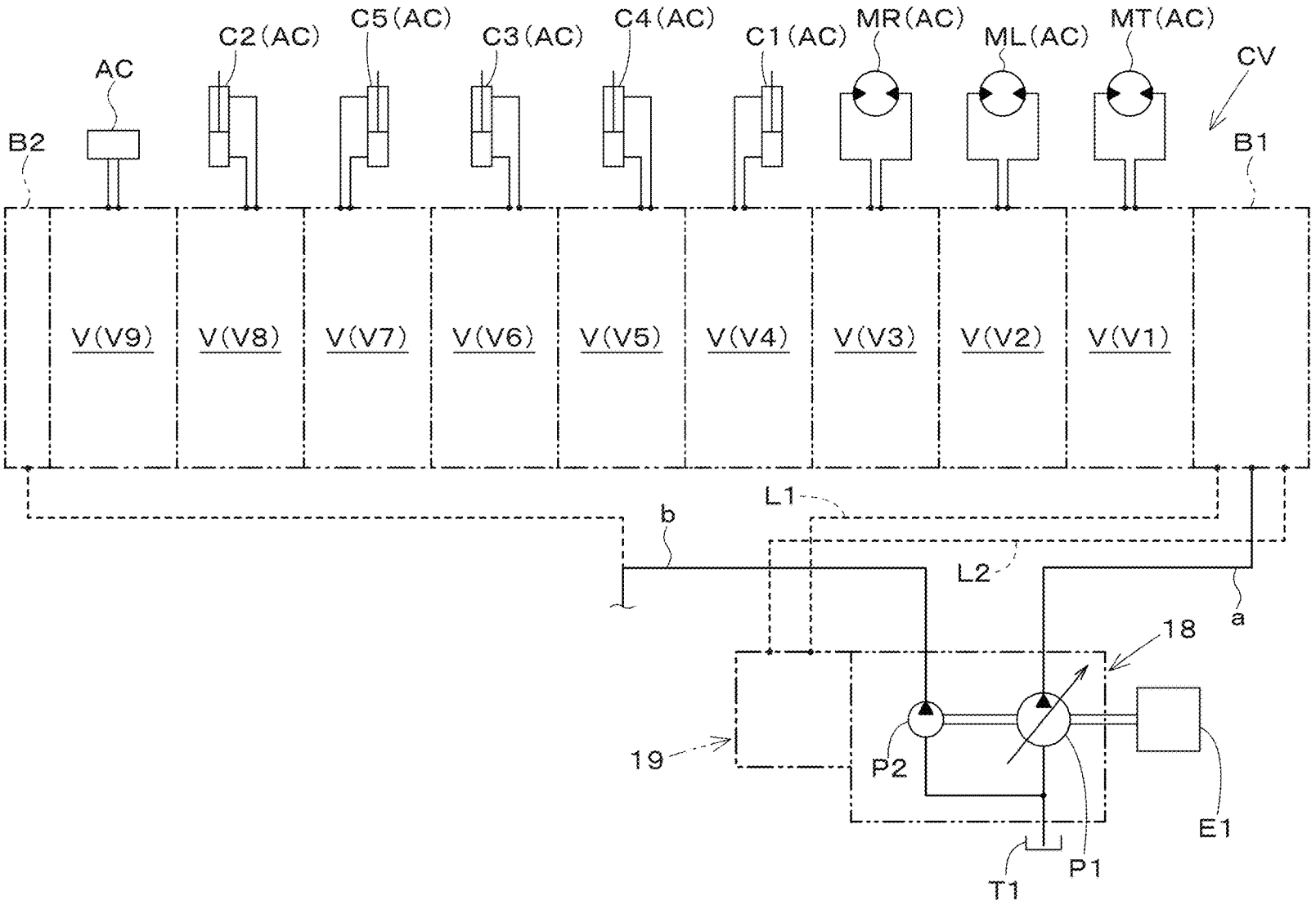
FIG. 2 is a schematic diagram of a hydraulic system that drives various hydraulic actuators.

FIG. 2 illustrates a schematic configuration of a hydraulic system for actuating the above-described various hydraulic actuators AC (MT, ML, MR, C1 to C5) (provided in the working machine 1).

As illustrated in FIG. 2, the hydraulic system includes a control valve unit CV, a hydraulic fluid supply unit 18, and a flow rate controller 19.

The control valve unit CV includes a plurality of control valves V (V1 to V9) that control the various hydraulic actuators AC (MT, ML, MR, C1 to C5), an inlet block B1, and an outlet block B2 that are disposed (stacked) in one direction, coupled to each other, and connected to each other by internal fluid passages.

The control valves V include a turn control valve V1 that controls the turning motor MT, a first travel control valve V2 that controls the traveling motor ML of the left traveling device 3L, a second travel control valve V3 that controls the traveling motor MR of the right traveling device 3R, a dozer control valve V4 that controls the dozer cylinder C1, an arm control valve V5 that controls the arm cylinder C4, a boom control valve V6 that controls the boom cylinder C3, a bucket control valve V7 that controls the bucket cylinder C5, a swing control valve V8 that controls the swing cylinder C2, and an SP control valve V9 that controls a hydraulic actuator AC provided in a hydraulic attachment when the hydraulic attachment is attached as a working tool.

The hydraulic fluid supply unit 18 is provided with a first pump (main pump) P1 for supplying a hydraulic fluid to actuate the hydraulic actuators AC (MR, ML, MT, C1 to C5) and a second pump (pilot pump) P2 for supplying a pilot pressure or a signal pressure such as a detection signal. The first pump P1 and the second pump P2 are driven by the prime mover E1.

The first pump P1 is constituted by a variable displacement hydraulic pump (swash-plate variable displacement axial pump) that can change the delivery amount by changing the angle of a swash plate. The fluid delivered from the first pump P1 is supplied to the inlet block B1 via a fluid passage a, and then supplied to each of the control valves V (V1 to V9). The second pump P2 (pilot pump) is constituted by a constant displacement gear pump. The fluid delivered from the second pump P2 is supplied as a pilot source pressure to the primary side of an operating device that pilot-operates a control valve via a fluid passage b. The flow rate controller 19 performs swash plate control of the first pump P1.

The swash plate control of the first pump P1 is performed by controlling pressure acting on a flow rate compensation piston that changes the swash plate angle of the first pump P1 by controlling a flow rate compensation valve provided in the flow rate controller 19.

The above-described hydraulic system employs a load sensing system.

The load sensing system is a system in which, when a plurality of hydraulic actuators AC among the plurality of hydraulic actuators AC provided in the working machine 1 are operated simultaneously, pressure compensation valves assembled in the control valves V function to adjust the load between the hydraulic actuators AC, and a pressure loss corresponding to the pressure difference from the highest load pressure is generated in the control valve V having a low load pressure, thereby allowing the fluid with a flow rate corresponding to the operation amount of the spool of the control valve V to flow (be distributed) regardless of the magnitude of the load.

Also, the load sensing system is a system capable of saving power and improving operability by controlling the delivery amount of the hydraulic pump (first pump P1) in accordance with the load pressure of each hydraulic actuator AC provided in the working machine 1 and delivering hydraulic power required for the load from the hydraulic pump (first pump P1).

The load sensing system includes a PLS signal line L1 that transmits the highest load pressure among the load pressures of the respective control valves V (V1 to V9) as a PLS signal pressure (load signal) to the flow rate controller 19 (flow rate compensation valve), and a PPS signal line L2 that transmits the delivery pressure of the first pump P1 as a PPS signal pressure to the flow rate controller 19 (flow rate compensation valve). The signal lines L1 and L2 are led out from the inlet block B1 and connected to the flow rate controller 19.

Figure 3:
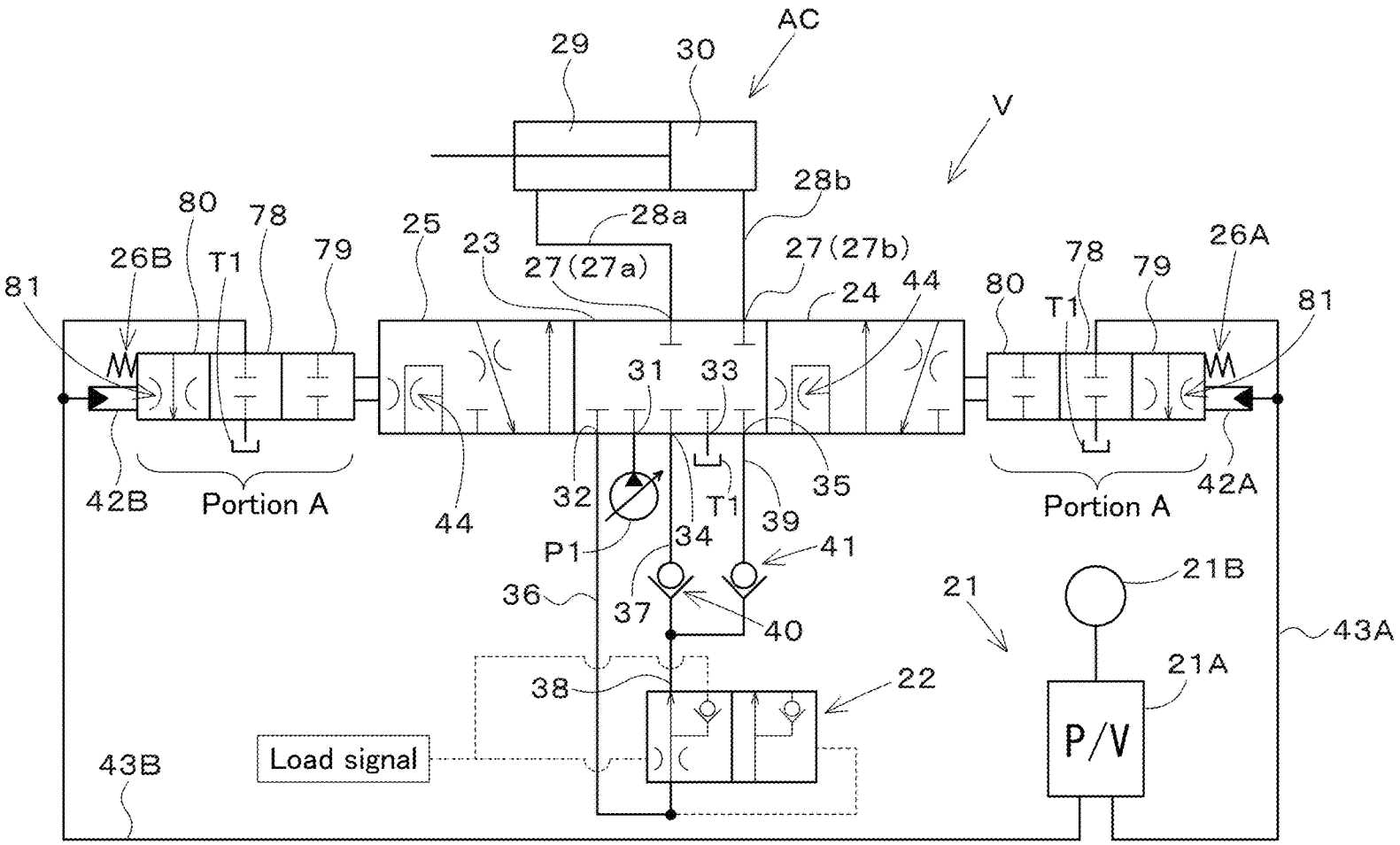
FIG. 3 is a hydraulic circuit diagram relating to one control valve.

FIG. 3 illustrates a schematic configuration of a hydraulic circuit relating to one control valve V.

As illustrated in FIG. 3, the control valve V is constituted by a pilot-operation switching valve that is pilot-operated by an operating device 21. The operating device 21 includes a pilot valve 21A that outputs a pilot pressure (pilot fluid) to the control valve V, and an operating lever 21B that operates the pilot valve 21A.

The control valve V includes a pressure compensation valve 22. The highest load pressure among the load pressures of the respective control valves V is transmitted as a load signal to the pressure compensation valve 22.

The control valve V is constituted by a seven-port three-position switching valve, and can be switched to a neutral position 23, a first switch position 24, and a second switch position 25. The control valve V is held in the neutral position 23 by urging forces of a neutral spring 26A on one side in a switching direction and a neutral spring 26B on another side opposite to the one side, and is switched from the neutral position 23 to the first switch position 24 or the second switch position 25 by a pilot pressure output from the pilot valve 21A.

The control valve V has a pair of actuator ports 27 (first actuator port 27*a*, second actuator port 27*b*) that are connected to a hydraulic actuator AC (a hydraulic cylinder in the illustrated example) to be controlled. In the illustrated example, the first actuator port 27*a* communicates with a rod-side fluid chamber 29 of the hydraulic actuator AC (hydraulic cylinder) via a first hydraulic pipe 28*a*, and the second actuator port 27*b* communicates with a bottom-side fluid chamber 30 of the hydraulic actuator AC (hydraulic cylinder) via a second hydraulic pipe 28*b*.

Additionally, the control valve V has a pump port 31, a lead-in port 32, a discharge port 33, a first inlet port 34, and a second inlet port 35. The pump port 31 communicates with a delivery port of the first pump P1 (hydraulic pump) from which the hydraulic fluid is delivered. The lead-in port 32 is connected to the pressure compensation valve 22 via a lead-in pipe 36. The discharge port 33 communicates with a hydraulic fluid tank T1. The first inlet port 34 is connected to the pressure compensation valve 22 via a first supply pipe 37 and a lead-out pipe 38. The second inlet port 35 is connected to the pressure compensation valve 22 via a second supply pipe 39 and the lead-out pipe 38. A first load check valve 40 is provided in the first supply pipe 37, and a second load check valve 41 is provided in the second supply pipe 39. The first load check valve 40 and the second load check valve 41 are check valves that prevent the pressure on the actuator port 27 side from flowing backward.

The control valve V includes a first pressure receiver 42A on the one side in the switching direction and a second pressure receiver 42B on the other side. The first pressure receiver 42A is connected to the pilot valve 21A via a first pilot pipe 43A. The second pressure receiver 42B is connected to the pilot valve 21A via a second pilot pipe 43B. Thus, when the pilot pressure output from the pilot valve 21A by operation of the operating lever 21B acts on the first pressure receiver 42A via the first pilot pipe 43A, the control valve V is switched from the neutral position 23 to the first switch position 24. Also, when the pilot pressure output from the pilot valve 21A by operation of the operating lever 21B acts on the second pressure receiver 42B via the second pilot pipe 43B, the control valve V is switched from the neutral position 23 to the second switch position 25.

In the first switch position 24, the pump port 31 communicates with the lead-in port 32 via a throttle 44, and the hydraulic fluid from the first pump P1 flows from the lead-in port 32 into the first inlet port 34 via the lead-in pipe 36→the pressure compensation valve 22→the lead-out pipe 38→the first supply pipe 37. The hydraulic fluid that has flowed into the first inlet port 34 flows from the first actuator port 27*a* into the rod-side fluid chamber 29 through the first hydraulic pipe 28*a*. Also, the hydraulic fluid flowing out of the bottom-side fluid chamber 30 flows into the second actuator port 27*b* via the second hydraulic pipe 28*b*, and flows from the second actuator port 27*b* into the hydraulic fluid tank T1 via the discharge port 33.

In the second switch position 25, the pump port 31 communicates with the lead-in port 32 via a throttle 44, and the hydraulic fluid from the first pump P1 flows from the lead-in port 32 into the second inlet port 35 via the lead-in pipe 36→the pressure compensation valve 22→the lead-out pipe 38→the second supply pipe 39. The hydraulic fluid that has flowed into the second inlet port 35 flows from the second actuator port 27*b* into the bottom-side fluid chamber 30 through the second hydraulic pipe 28*b*. Also, the hydraulic fluid flowing out of the rod-side fluid chamber 29 flows into the first actuator port 27*a* via the first hydraulic pipe 28*a*, and flows from the first actuator port 27*a* into the hydraulic fluid tank T1 via the discharge port 33.

Figure 4:
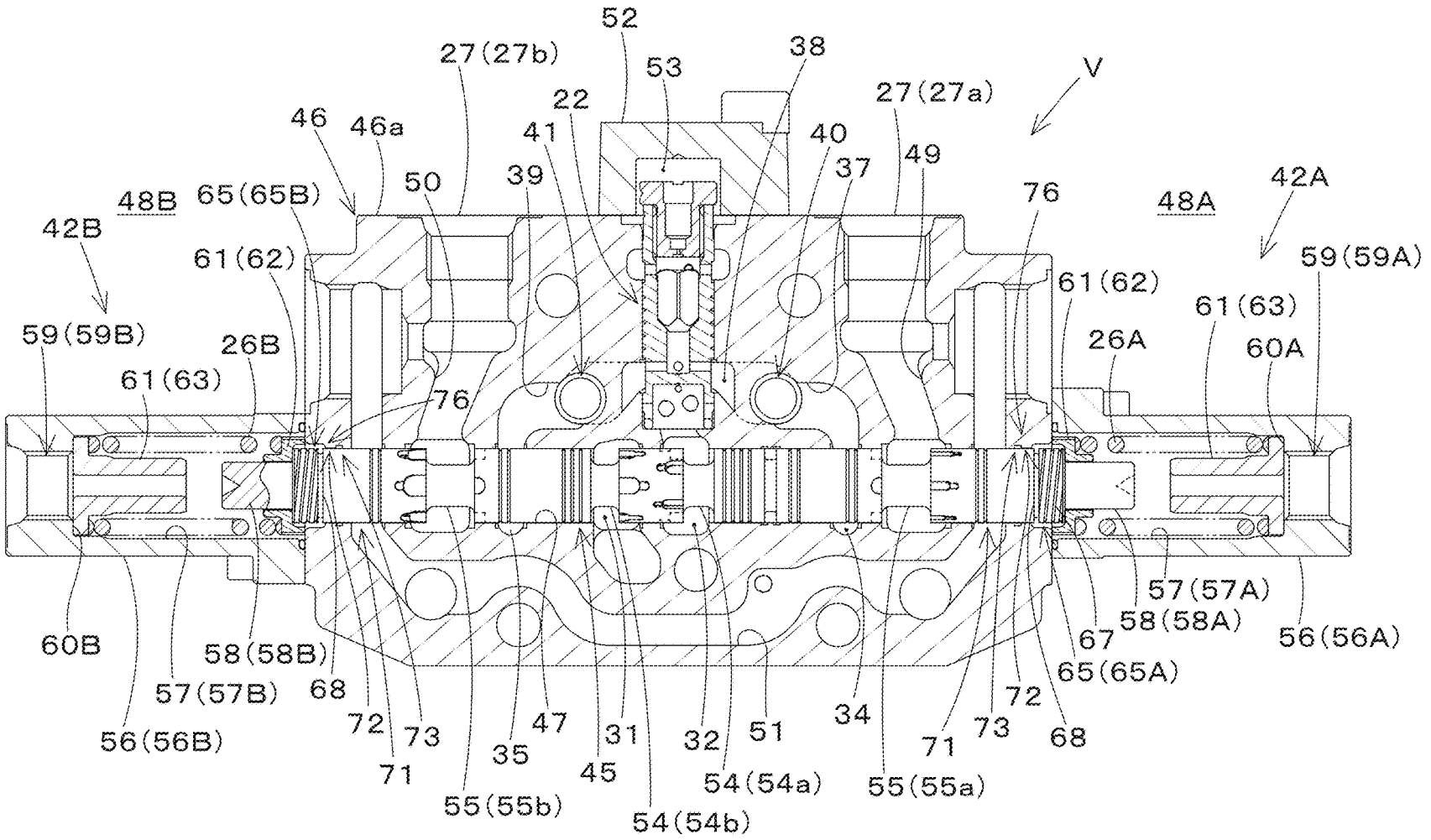
FIG. 4 is a sectional view of the control valve in a neutral position.

FIG. 4 is a sectional view of the control valve V. The sectional view is a sectional view taken along a plane orthogonal to a stacking direction of the plurality of control valves V. As illustrated in FIG. 4, the control valve V is installed in the machine body 2.

As illustrated in FIG. 4, the control valve V has a valve body 46 in which a spool 45, the pressure compensation valve 22, and the like are assembled and in which a fluid passage is formed. The valve body 46 has a spool hole 47 in which the spool 45 is fitted slidably in an axial direction. The spool hole 47 is formed in the valve body 46 so as to penetrate in the horizontal direction.

The pair of actuator ports 27 (first actuator port 27*a*, second actuator port 27*b*) that are connected to the hydraulic actuator AC are formed in the valve body 46. Specifically, the pair of actuator ports 27 are formed in an upper surface 46*a* of the valve body 46 (a surface of the valve body 46 parallel to the spool hole 47). The first actuator port 27*a* is formed in one end portion 48A of the valve body 46 in a spool axial direction (the axial direction of the spool 45), and the second actuator port 27*b* is formed in another end portion 48B of the valve body 46 in the spool axial direction. The first actuator port 27*a* communicates with the spool hole 47 via a first flow passage 49, and the second actuator port 27*b* communicates with the spool hole 47 via a second flow passage 50.

The valve body 46 has a discharge passage 51 that discharges the hydraulic fluid returning from the hydraulic actuator AC via the actuator port 27, to the outside. Specifically, the discharge passage 51 communicates with the hydraulic fluid tank T1 via the discharge port 33. Thus, the hydraulic fluid returning from the hydraulic actuator AC flows to the hydraulic fluid tank T1 via the discharge passage 51, the discharge port 33, and the like. The discharge passage 51 communicates with the spool hole 47 between one end of the valve body 46 in the spool axial direction and the first flow passage 49, and communicates with the spool hole 47 between another end of the valve body 46 in the spool axial direction and the second flow passage 50.

The lead-in port 32 is formed in a substantially center portion of the spool hole 47 in the axial direction in the valve body 46. The pump port 31 is formed on the other end portion 48B side of the lead-in port 32 in the spool axial direction to be spaced apart in the spool axial direction.

The pressure compensation valve 22 is provided in a substantially center portion of the valve body 46 in the spool axial direction so as to extend from the lead-in port 32 to the upper surface 46*a*. A block member 52 is fixed to the upper surface 46*a* of the valve body 46 by a bolt or the like at a position corresponding to the pressure compensation valve 22. A load pressure lead-in chamber 53 to which the highest load pressure among the plurality of hydraulic actuators AC is led is formed in the block member 52. A load signal is led from the load pressure lead-in chamber 53 into the pressure compensation valve 22.

The first inlet port 34 is formed in the spool hole 47 at a position between the lead-in port 32 and the first flow passage 49 and near the first flow passage 49. The hydraulic fluid that has flowed from the lead-in port 32 to the lead-out pipe 38 via the pressure compensation valve 22 flows to the first inlet port 34 via the first supply pipe 37 including the first load check valve 40. Also, the second inlet port 35 is formed in the spool hole 47 at a position between the pump port 31 and the second flow passage 50 and near the second flow passage 50. The hydraulic fluid flowing through the lead-out pipe 38 flows to the second inlet port 35 via the second supply pipe 39 including the second load check valve 41.

A pair of first communication grooves 54 for causing the pump port 31 and the lead-in port 32 to communicate with each other are formed in a substantially center portion of the spool 45 in the axial direction. The first communication grooves 54 are constituted by grooves that are formed in annular shapes in a circumferential direction on an outer periphery of the spool 45. When the control valve V is in the neutral position 23, the communication between the pump port 31 and the lead-in port 32 by the first communication grooves 54 is blocked. When the control valve V is switched from the neutral position 23 to the first switch position 24, one (right) first communication groove 54 (54*a*) causes the pump port 31 and the lead-in port 32 to communicate with each other via a notch (throttle 44). Also, when the control valve V is switched from the neutral position 23 to the second switch position 25, another (left) first communication groove 54 (54*b*) causes the pump port 31 and the lead-in port 32 to communicate with each other via a notch (throttle 44).

A pair of second communication grooves 55 are formed in both end portions of the spool 45 in the axial direction. The second communication grooves 55 are constituted by grooves that are formed in annular shapes in the circumferential direction on the outer periphery of the spool 45.

A (one, right) second communication groove 55 (55*a*) in the one end portion 48A in the spool axial direction is a groove for causing the first flow passage 49 (first actuator port 27*a*) and the first inlet port 34 to communicate with each other or causing the first flow passage 49 and the discharge passage 51 to communicate with each other. When the control valve V is in the neutral position 23, the communication between the first flow passage 49 and the first inlet port 34 and the communication between the first flow passage 49 and the discharge passage 51 by the one second communication groove 55 (55*a*) are blocked. When the control valve V is switched from the neutral position 23 to the first switch position 24, the one second communication groove 55 (55*a*) causes the first flow passage 49 and the first inlet port 34 to communicate with each other, and when the control valve V is switched to the second switch position 25, the one second communication groove 55 (55*a*) causes the first flow passage 49 and the discharge passage 51 to communicate with each other.

A (another, left) second communication groove 55 (55*b*) in the other end portion 48B in the spool axial direction is a groove for causing the second flow passage 50 (second actuator port 27*b*) and the second inlet port 35 to communicate with each other or causing the second flow passage 50 and the discharge passage 51 to communicate with each other. When the control valve V is in the neutral position 23, the communication between the second flow passage 50 and the second inlet port 35 and the communication between the second flow passage 50 and the discharge passage 51 by the other second communication groove 55 (55*b*) are blocked. When the control valve V is switched from the neutral position 23 to the first switch position 24, the other second communication groove 55 (55*b*) causes the second flow passage 50 and the discharge passage 51 to communicate with each other, and when the control valve V is switched to the second switch position 25, the other second communication groove 55 (55*b*) causes the second flow passage 50 and the second inlet port 35 to communicate with each other.

A pair of spool caps 56 (first spool cap 56A, second spool cap 56B) are attached to both ends of the valve body 46 in the spool axial direction. The first spool cap 56A is a component of the first pressure receiver 42A, and is attached at the one end portion 48A of the valve body 46 in the spool axial direction. The second spool cap 56B is a component of the second pressure receiver 42B, and is attached at the other end portion 48B of the valve body 46 in the spool axial direction.

A substantially cylindrical pilot chamber 57 (first pilot chamber 57A) into which the pilot pressure (pilot fluid) is led from the first pilot pipe 43A is formed in the first spool cap 56A. The first pilot chamber 57A is disposed adjacent to the spool hole 47 in the spool axial direction (horizontal direction) and communicates with the spool hole 47. A guide 58 (58A) formed at one end of the spool 45 is inserted into the first pilot chamber 57A. When the pilot fluid is led into the first pilot chamber 57A, the guide 58A at the one end of the spool 45 is pressed with the pilot fluid, the spool 45 moves leftward in FIG. 4, and the control valve V is switched from the neutral position 23 to the first switch position 24.

A substantially cylindrical pilot chamber 57 (second pilot chamber 57B) into which the pilot pressure (pilot fluid) is led from the second pilot pipe 43B is formed in the second spool cap 56B. The second pilot chamber 57B is disposed adjacent to the spool hole 47 in the spool axial direction (horizontal direction) and communicates with the spool hole 47. A guide 58 (58B) formed at another end of the spool 45 is inserted into the second pilot chamber 57B. When the pilot fluid is led into the second pilot chamber 57B, the guide 58B at the other end of the spool 45 is pressed with the pilot fluid, the spool 45 moves rightward in FIG. 4, and the control valve V is switched from the neutral position 23 to the second switch position 25.

Note that, by the pressure of the pilot fluid led into each pilot chamber 57, the movement amount of the spool 45 can be adjusted, and the supply amount of the hydraulic fluid to the hydraulic actuator AC can be adjusted.

A passage hole 59 (59A) to which the first pilot pipe 43A is connected and that communicates with the first pilot chamber 57A is formed opposite to the spool hole 47 in the first spool cap 56A. A step 60A is formed between the passage hole 59A and the first pilot chamber 57A.

A passage hole 59 (59B) to which the second pilot pipe 43B is connected and that communicates with the second pilot chamber 57B is formed opposite to the spool hole 47 in the second spool cap 56B. A step 60B is formed between the passage hole 59B and the second pilot chamber 57B.

The internal configurations of the pair of spool caps 56 are the same, and hence, the pair of spool caps 56 will be described collectively with reference to FIGS. 4, 5, and 6.

As illustrated in FIG. 4, a pair of spring seats 61 (first spring seat 62, second spring seat 63) and the neutral spring 26A or 26B interposed between the pair of spring seats 61 are assembled in the pilot chamber 57 (first pilot chamber 57A, second pilot chamber 57B).

Figure 5:
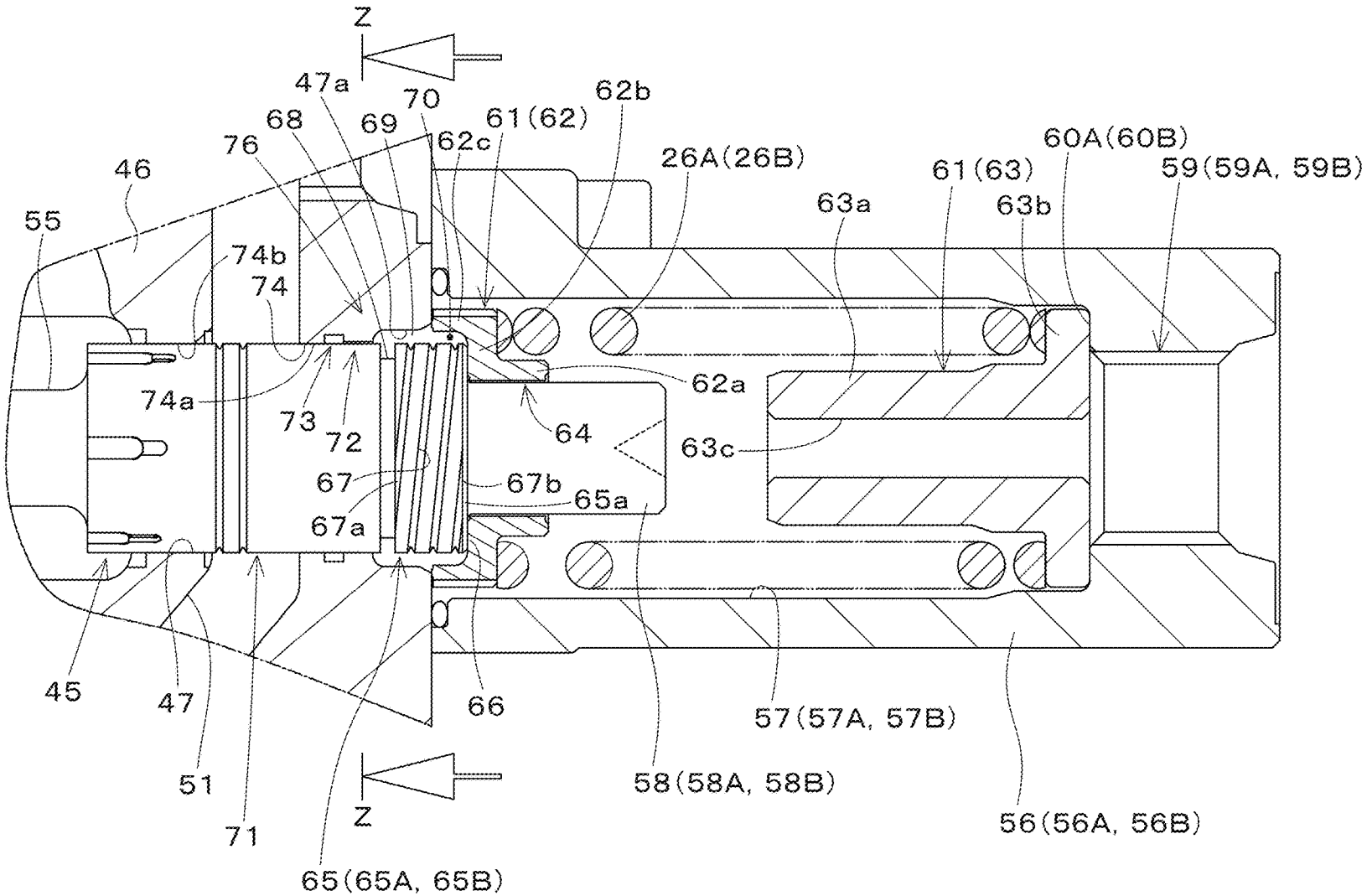
FIG. 5 is an enlarged sectional view of a main portion.

As illustrated in FIG. 5, the first spring seat 62 has a spring guide 62*a*, a spring receiver 62*b*, and a tubular portion 62*c*. The spring guide 62*a* is externally fitted on the guide 58 so as to be relatively movable in the spool axial direction.

Figure 6:
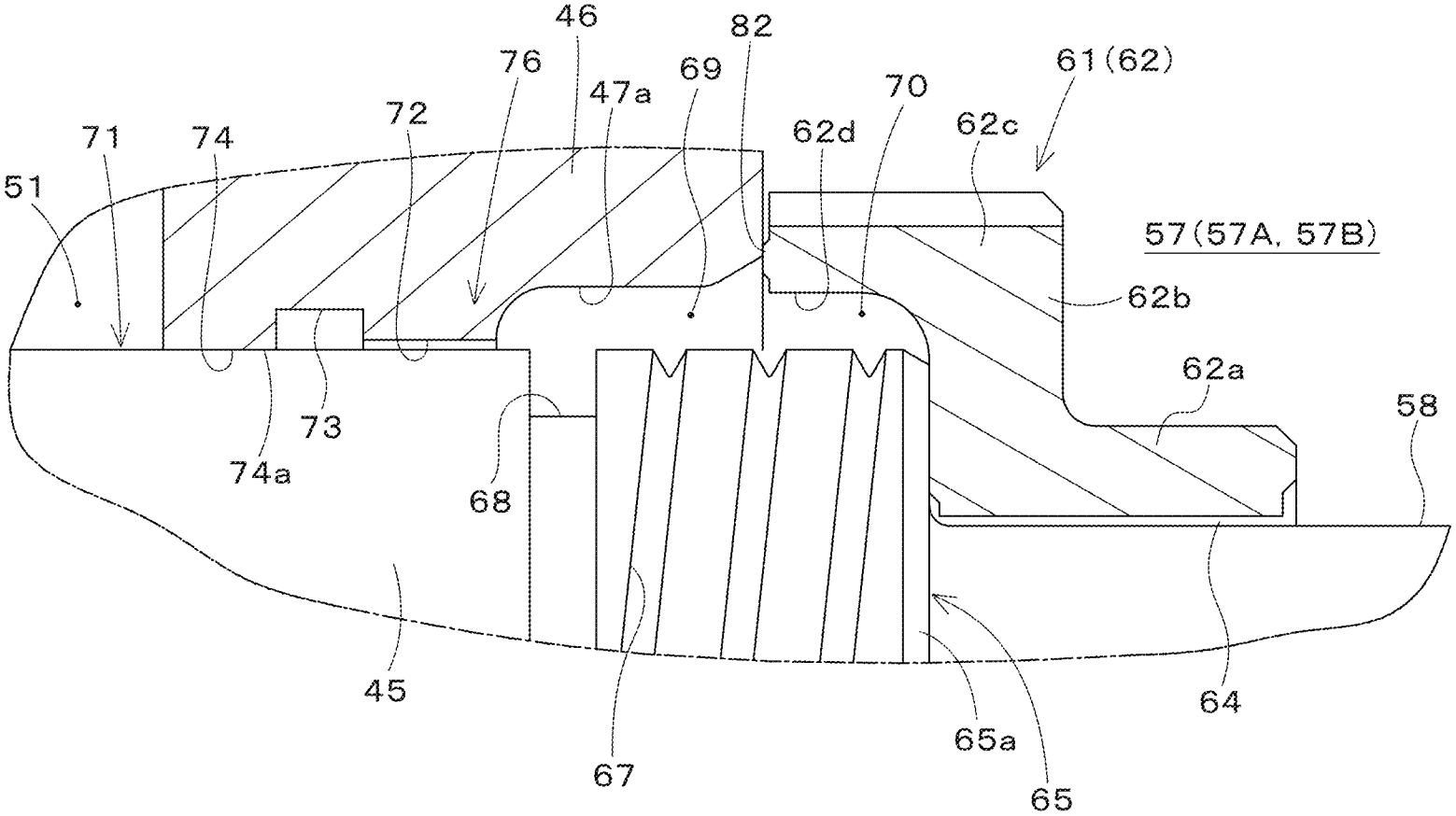
FIG. 6 is a sectional view of an air removing circuit.

As illustrated in FIG. 6, a gap is provided between an inner peripheral surface of the spring guide 62*a* and an outer peripheral surface of the guide 58. The spring receiver 62*b* protrudes radially outward from a portion of the spring guide 62*a* near the valve body 46. The tubular portion 62*c* extends from an outer periphery of the spring receiver 62*b* toward the valve body 46 and is in contact with the valve body 46.

As illustrated in FIG. 5, the second spring seat 63 has a spring guide 63*a* and a spring receiver 63*b*. The spring guide 63*a* is formed in a tubular shape having an axis extending in the spool axial direction, and is disposed so as to face the guide 58 with a space in the spool axial direction. The spring receiver 63*b* protrudes radially outward from an end portion of the spring guide 63*a* near the passage hole 59 and is in contact with the step 60A (60B). An inner hole 63*c* of the spring guide 63*a* communicates with the pilot chamber 57 and the passage hole 59, and the pilot pressure is led from the passage hole 59 into the pilot chamber 57 via the inner hole 63*c*.

The neutral spring 26A (26B) is formed by a coil spring, and has one end fitted on the spring guide 62*a* of the first spring seat 62 and another end fitted on the spring guide 63*a* of the second spring seat 63, and is interposed in a compressed state between the spring receiver 62*b* and the spring receiver 63*b*.

As illustrated in FIG. 4, a pair of groove forming portions 65 are provided in both end portions of the spool 45 in the axial direction. One (right) groove forming portion 65A is located adjacent to the guide 58A in the spool axial direction and inward of the guide 58A in the spool axial direction (in a direction from the end portion of the spool 45 in the axial direction toward a center portion of the spool 45 in the axial direction). Another (left) groove forming portion 65B is located adjacent to the guide 58B in the spool axial direction and inward of the guide 58B in the spool axial direction. Each groove forming portion 65 is formed to have a larger diameter than that of the guide 58. Thus, as illustrated in FIG. 5, a step 66 is formed between the groove forming portion 65 and the guide 58. The spring guide 62*a* of the first spring seat 62 is in contact with the step 66.

As illustrated in FIG. 5, a spiral groove 67 is formed in each groove forming portion 65 (the outer periphery of the spool 45). The spiral groove 67 is a groove formed in a spiral shape on an outer periphery of the groove forming portion 65 (spool 45), and is a groove with a spiral shape that advances in the spool axial direction. The spiral groove 67 is formed over the groove forming portion 65 from one end to another end in the spool axial direction.

A tapered surface 65*a* that gradually decreases in size outward in the spool axial direction is formed in an outer portion of the groove forming portion 65 in the spool axial direction (a direction from the center portion of the spool 45 in the axial direction toward the end portion of the spool 45 in the axial direction).

An annular groove 68 is formed inward of the groove forming portion 65 of the spool 45 in the spool axial direction. The annular groove 68 is formed adjacent to the groove forming portion 65 in the spool axial direction. The annular groove 68 is a groove formed in the spool 45 in an annular shape in the circumferential direction.

The spiral groove 67 is formed from the tapered surface 65*a* to the annular groove 68. The annular groove 68 communicates with an end portion 67*a* located in an inner portion of the spiral groove 67 in the spool axial direction.

As illustrated in FIGS. 5 and 6, a space (first space) 69 formed by a peripheral surface 47*a* that covers the spiral groove 67 and the annular groove 68 to be spaced apart from the outer peripheries is provided in an end portion of the spool hole 47 of the valve body 46. Also, the tubular portion 62*c* of the first spring seat 62 covers the spiral groove 67 to be spaced apart from the outer periphery, and a space (second space) 70 is formed by an inner peripheral surface 62*d* of the tubular portion 62*c*. The first space 69 and the second space 70 communicate with each other.

As illustrated in FIGS. 4 and 5, a land 71 between the annular groove 68 and the second communication groove 55 of the spool 45 is located inward of the groove forming portion 65 in the spool axial direction, and is formed adjacent to the groove forming portion 65 via the annular groove 68 in the spool axial direction. Also, the land 71 is formed to have the same diameter as that of the groove forming portion 65.

As illustrated in FIGS. 5 and 6, at least one axial groove 72 formed along the axial direction of the spool 45 and a circumferential groove 73 formed in an annular shape in the circumferential direction on an inner surface of the spool hole 47 are formed on a portion of the inner surface of the spool hole 47 corresponding to the land 71. In other words, the axial groove 72 and the circumferential groove 73 are formed on each of both end portions of the inner surface of the spool hole 47 in the spool axial direction and in the vicinity of the corresponding spiral groove 67. Also, the axial groove 72 and the circumferential groove 73 are formed in an inner peripheral surface of a support hole 74 of the spool hole 47. The support hole 74 supports the land 71. As illustrated in FIG. 5, the discharge passage 51 intersects with the support hole 74. The support hole 74 has a portion (first portion) 74*a* closer to the annular groove 68 than the discharge passage 51 and a portion (second portion) 74*b* closer to the second communication groove 55 than the discharge passage 51. The axial groove 72 and the circumferential groove 73 are formed in the first portion 74*a*. In other words, the axial groove 72 and the circumferential groove 73 are formed between the pilot chamber 57 and the discharge passage 51.

Figure 7:
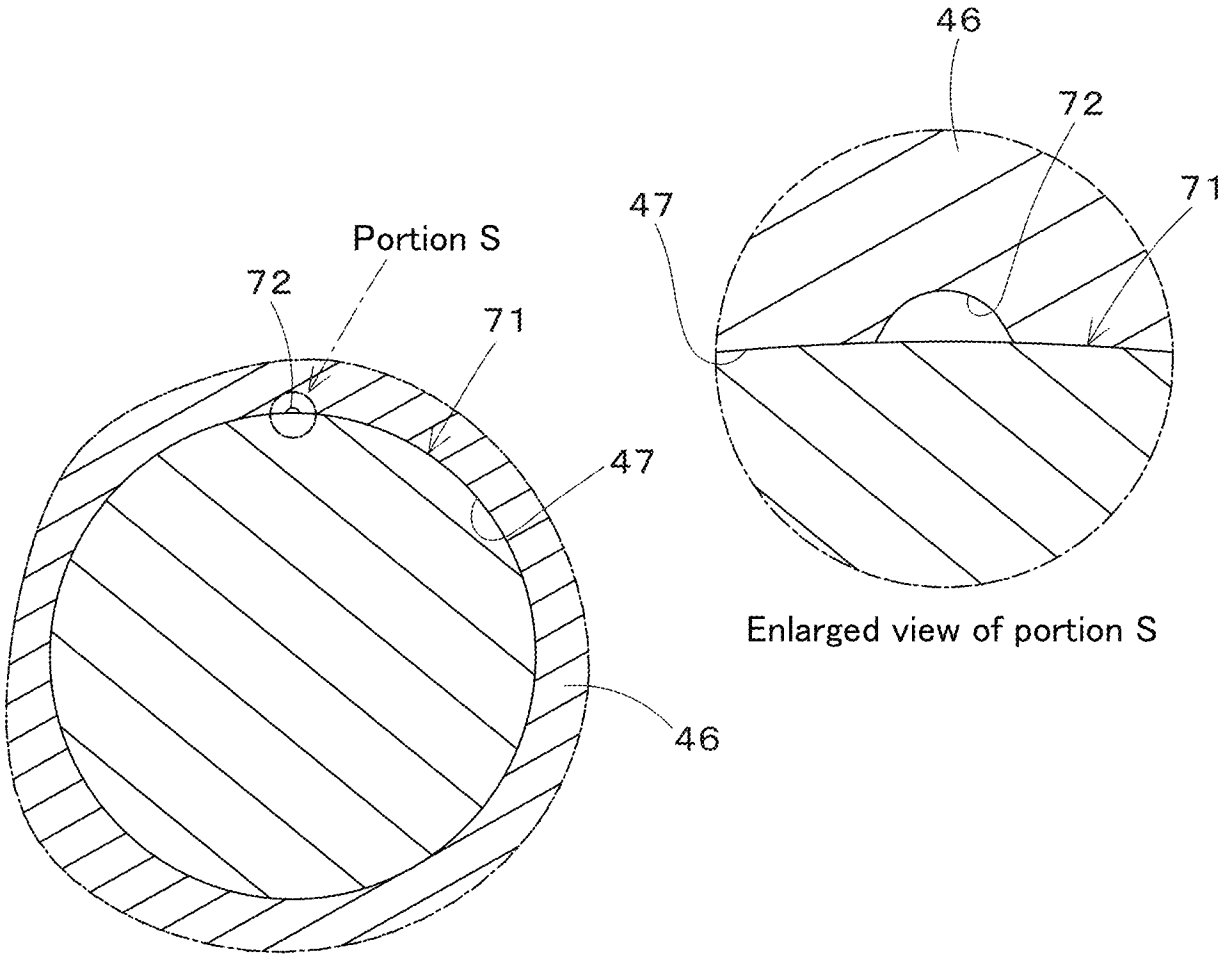
FIG. 7 is a sectional view taken along line Z-Z in FIG. 5.

As illustrated in FIGS. 5 and 6, the axial groove 72 is formed from an end portion of the first portion 74*a* (support hole 74) near the annular groove 68 toward a center portion of the first portion 74*a* in the spool axial direction along the spool axial direction. The axial groove 72 communicates with the first space 69. Also, the axial groove 72 is formed above (vertically above) the spool 45. As illustrated in FIG. 7, the axial groove 72 has a substantially arc-shaped cross section. Note that the cross-sectional shape of the axial groove 72 is not limited to the arc shape, and the axial groove 72 may be, for example, a V-shaped groove. The passage resistance of the axial groove 72 is smaller than the passage resistance of the spiral groove 67.

As illustrated in FIGS. 5 and 6, the circumferential groove 73 is formed adjacently inward of the axial groove 72 in the spool axial direction (near the center of the spool 45 in the axial direction). In the present embodiment, the circumferential groove 73 is formed near the center portion of the first portion 74*a* in the spool axial direction. In other words, the circumferential groove 73 is formed adjacent to an end portion of the axial groove 72 opposite to an end portion of the axial groove 72 that communicates with the pilot chamber 57. The axial groove 72 and the circumferential groove 73 communicate with each other. The groove depth of the circumferential groove 73 is formed to be larger than the groove depth of the axial groove 72.

As illustrated in FIGS. 5 and 6, the control valve V of the present embodiment includes at least one air removing circuit 76 for removing air accumulated in the pilot chamber 57. The air removing circuit 76 is a circuit that, when the spool 45 is moved by a predetermined amount from the neutral position 23 with the pilot fluid led into the pilot chamber 57, causes the pilot chamber 57 and the discharge passage 51 to communicate with each other and partially leaks the pilot fluid led into the pilot chamber 57 to the discharge passage 51, thereby removing air accumulated in the pilot chamber 57. Air accumulated in the pilot chamber 57 is removed by the air removing circuit 76, and thus switching responsiveness of the spool 45 (control valve V) can be improved.

As illustrated in FIG. 4, the air removing circuit 76 is provided in each of both end portions of the control valve V in the spool axial direction. The air removing circuit 76 in the one end portion 48A of the control valve V in the spool axial direction is a passage for removing air by leaking the pilot fluid led from the first pilot pipe 43A into the first pilot chamber 57A. The air removing circuit 76 in the other end portion 48B of the control valve V in the spool axial direction is a passage for removing air by leaking the pilot fluid led from the second pilot pipe 43B into the second pilot chamber 57B.

Figure 8:
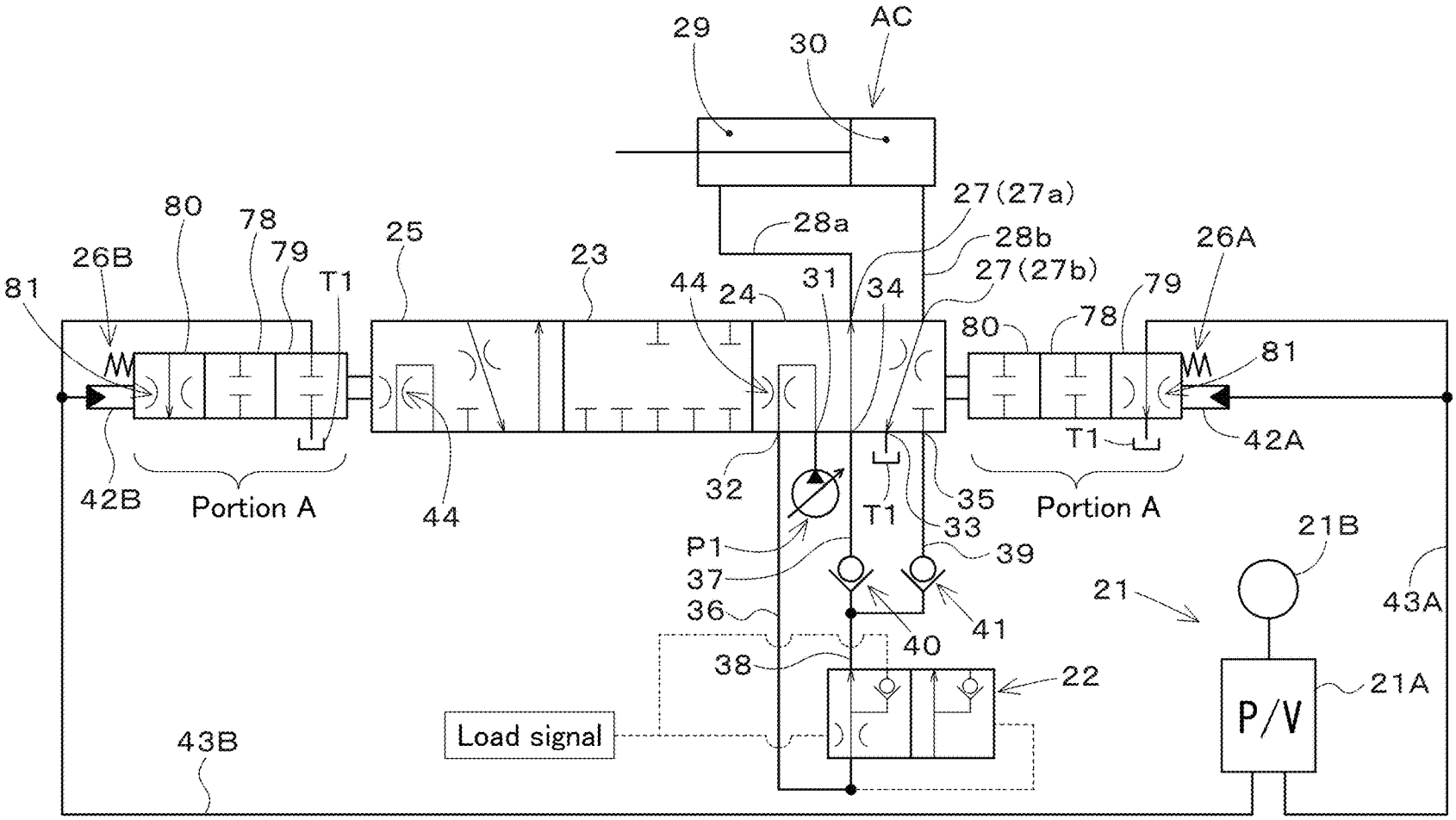
FIG. 8 is a hydraulic circuit diagram upon switching to a first switch position.

In FIGS. 3 and 8, a portion A schematically illustrates a state of the air removing circuit 76. A first state 78 in the portion A indicates a state of the air removing circuit 76 when the control valve V (spool 45) is in the neutral position 23. A second state 79 in the portion A indicates a state of the air removing circuit 76 when the control valve V (spool 45) is switched to the first switch position 24. A third state 80 in the portion A indicates a state of the air removing circuit 76 when the control valve V (spool 45) is switched to the second switch position 25.

As illustrated in FIG. 3, when the control valve V is neutral (neutral position 23), as indicated in the first state 78, the leak of the pilot fluid from the pilot chamber 57 to the discharge passage 51 by the air removing circuit 76 is blocked.

As illustrated in FIG. 8, when the control valve V is switched to the first switch position 24, as indicated in the second state 79, the air removing circuit 76 in the one end portion of the control valve V leaks the pilot fluid supplied to the first pressure receiver 42A via a throttle 81, to the hydraulic fluid tank T1. In contrast, the leak of the pilot fluid by the air removing circuit 76 in the other end portion of the control valve V is blocked.

When the control valve V is switched to the second switch position 25 (not illustrated), as indicated in the third state 80, the leak of the pilot fluid by the air removing circuit 76 in the one end portion of the control valve V is blocked, and the air removing circuit 76 in the other end portion of the control valve V leaks the pilot fluid to the hydraulic fluid tank T1 via a throttle 81.

Next, action and operation of the air removing circuit 76 will be described in detail with reference to a sectional view of the control valve V.

As illustrated in FIGS. 5 and 6, the air removing circuit 76 includes the spiral groove 67, the annular groove 68, the axial groove 72, and the circumferential groove 73.

As illustrated in FIGS. 5 and 6, when the control valve V is in the neutral position 23, the spiral groove 67 and the annular groove 68 are located outward of the axial groove 72 in the spool axial direction and do not communicate with the discharge passage 51. Also, an outer periphery of the land 71 is in contact with an inner surface of the support hole 74 (spool hole 47) over the entire periphery between the circumferential groove 73 and the discharge passage 51, and hence the axial groove 72 and the circumferential groove 73 also do not communicate with the discharge passage 51. That is, when the control valve V is in the neutral position 23, the communication between the pilot chamber 57 and the discharge passage 51 by the air removing circuit 76 is blocked.

Further, when the control valve V is in the neutral position 23, an outer surface of the groove forming portion 65 in the spool axial direction is in contact with the spring guide 62*a* of the first spring seat 62, and the flow of the pilot fluid from a passage 64 constituted by the gap between the inner peripheral surface of the spring guide 62*a* of the first spring seat 62 and the outer peripheral surface of the guide 58 to the second space 70 is blocked. Note that the flow of the pilot fluid from the passage 64 to the second space 70 does not necessarily have to be strictly blocked. For example, a backlash (minute gap) may be provided between the spool 45 and the first spring seat 62, and the passage 64 and the second space 70 may communicate with each other via the gap generated by the backlash when the control valve V is in the neutral position 23.

Additionally or alternatively, as illustrated in FIG. 6, a slit for communication between the pilot chamber 57 and the second space 70 may be formed in a contact portion 82 of the first spring seat 62 against the valve body 46, and the pilot chamber 57 and the second space 70 may always communicate with each other via the slit.

By forming the slit, as described later, when the spool 45 moves from the neutral position 23 and the pilot fluid flows from the pilot chamber 57 to the second space 70 via the passage 64, a constant flow rate can be ensured. For example, only with the flow of the fluid from the passage 64 to the second space 70, the flow of the fluid may be excessively restricted. Hence, by forming the slit, a constant flow rate can be ensured. That is, when it is desirable to ensure a constant flow rate, the slit may be provided as described above.

FIGS. 9 to 12 illustrate a state in which the control valve V is switched from the neutral position 23 to the first switch position 24.

Figure 9:
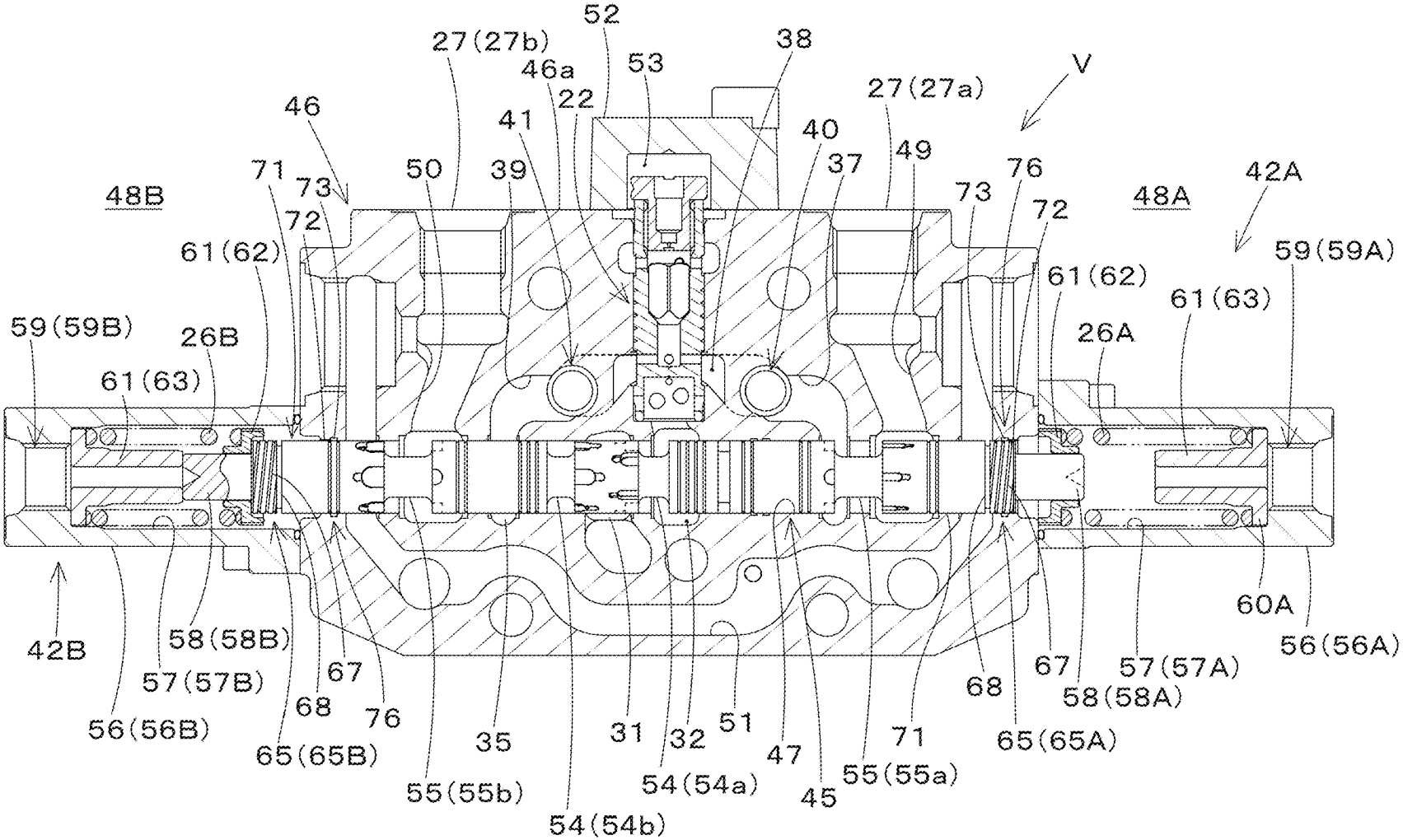
FIG. 9 is a sectional view of the control valve upon switching to the first switch position.
Figure 10:
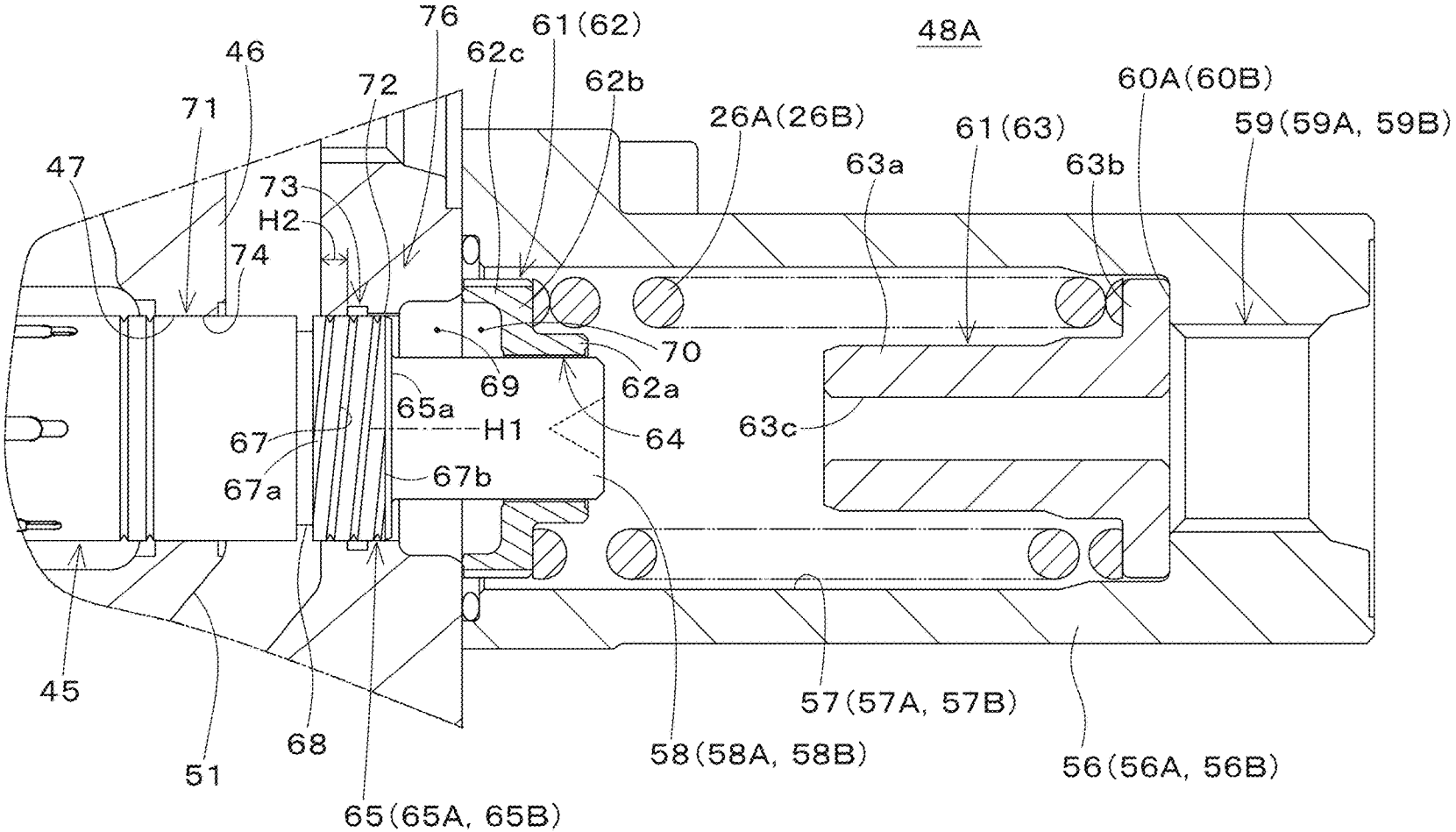
FIG. 10 is an enlarged sectional view of a main portion in the first switch position.

As illustrated in FIGS. 9 and 10, when the control valve V is switched to the first switch position 24, the spool 45 moves leftward from the neutral position 23. When the spool 45 moves from the neutral position 23 to the first switch position 24, the inner portion of the spiral groove 67 in the spool axial direction and the annular groove 68 move from outside the axial groove 72 in the spool axial direction (near the pilot chamber 57), pass through (across) the axial groove 72 and the circumferential groove 73, and move to a position communicating with the discharge passage 51. Then, in the first switch position 24, as illustrated in FIG. 10, the inner portion of the spiral groove 67 in the spool axial direction communicates with the circumferential groove 73 and the discharge passage 51.

Figure 11:
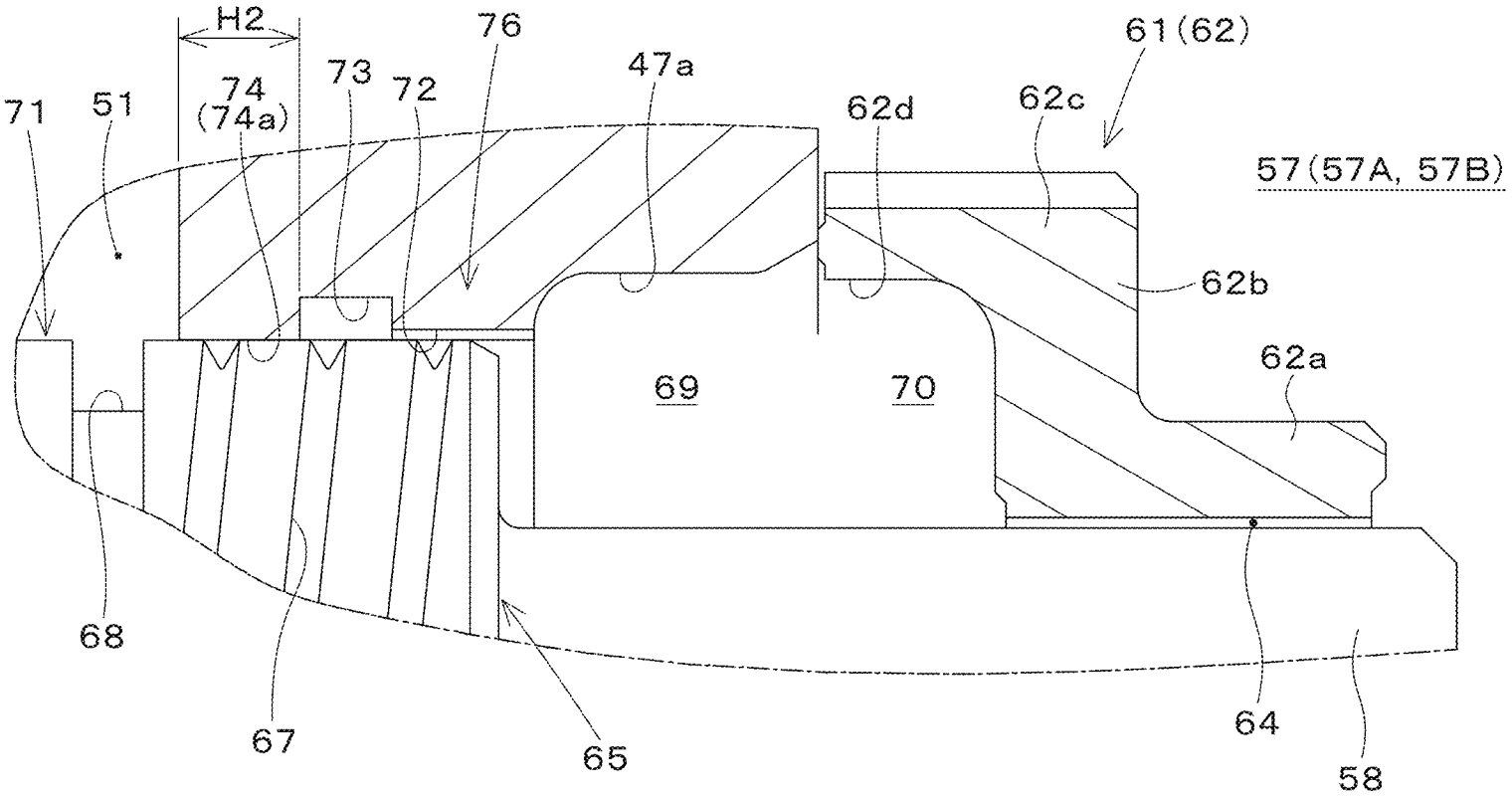
FIG. 11 is a sectional view of the air removing circuit in the first switch position.

As illustrated in FIGS. 10 and 11, when the control valve V has been switched to the first switch position 24, the groove forming portion 65 is separated from the spring guide 62*a*, and the passage 64 and the second space 70 communicate with each other in the one end portion 48A of the spool 45 in the axial direction. Also, the annular groove 68 and the end portion 67*a* located in the inner portion of the spiral groove 67 in the spool axial direction communicate with the discharge passage 51, and an outer portion of the spiral groove 67 in the spool axial direction overlaps the circumferential groove 73 and the axial groove 72, so that the circumferential groove 73 and the axial groove 72 communicate with the spiral groove 67. That is, the first pilot chamber 57A and the discharge passage 51 communicate with each other via the air removing circuit 76. Thus, the pilot fluid led into the first pilot chamber 57A partially flows to the discharge passage 51 via the passage 64→the second space 70→the first space 69→the axial groove 72 and via the circumferential groove 73→the spiral groove 67→the annular groove 68, and flows from the discharge passage 51 toward the hydraulic fluid tank T1. Also, the pilot fluid led into the first space 69 flows into the spiral groove 67 from an end portion 67*b* located in the outer portion of the spiral groove 67 in the spool axial direction, flows to the discharge passage 51 via the spiral groove 67 and the annular groove 68, and flows from the discharge passage 51 to the hydraulic fluid tank T1.

Figure 12:
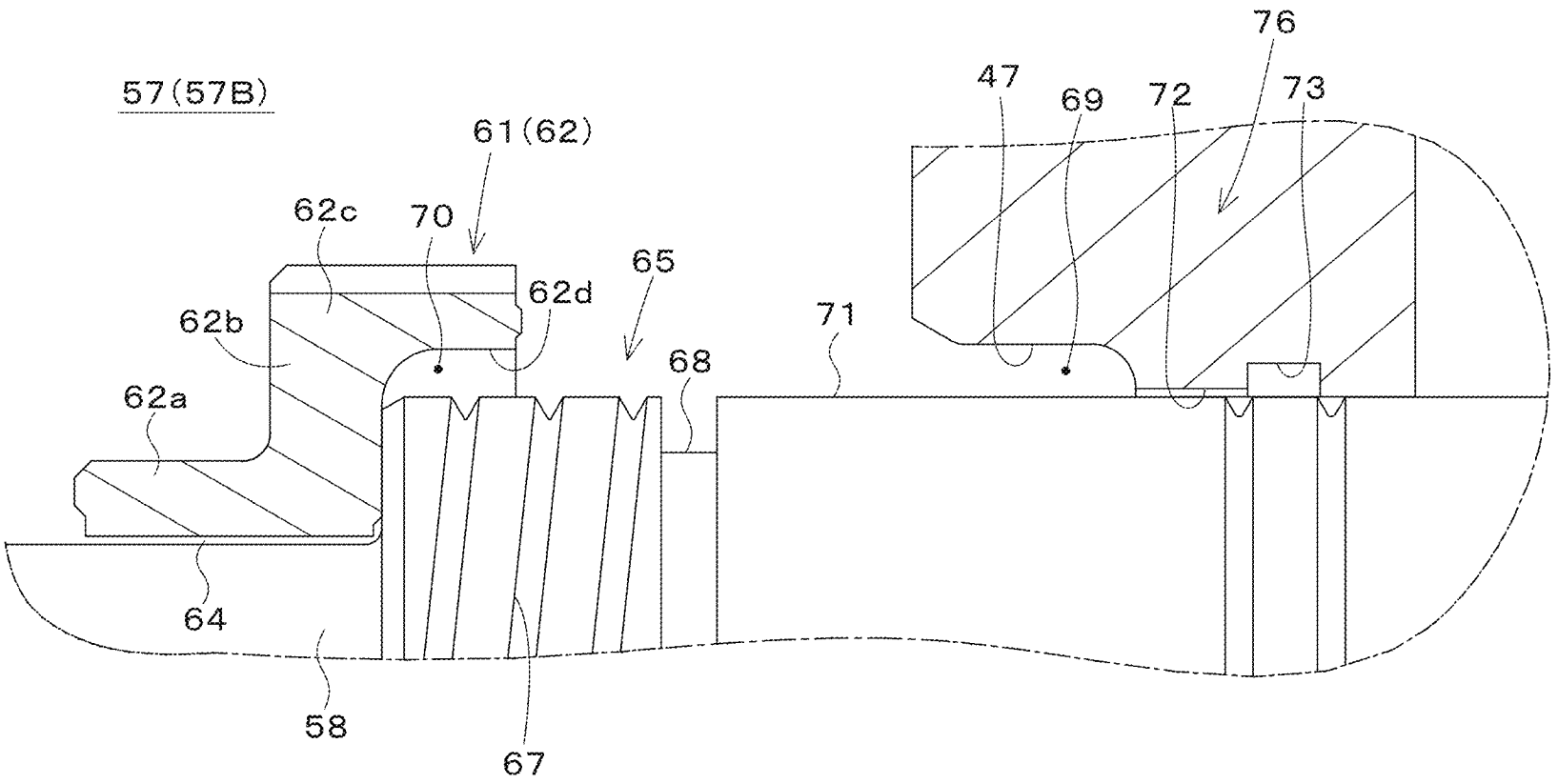
FIG. 12 is a sectional view of another end portion of a spool in the first switch position.

In contrast, as illustrated in FIG. 9, when the spool 45 moves leftward from the neutral position 23, the groove forming portion 65 pushes the first spring seat 62 to compress the neutral spring 26B, and the guide 58 comes into contact with the second spring seat 63 in the other end portion 48B of the control valve V in the axial direction. Thus, the movement of the spool 45 is stopped. Also, as illustrated in FIG. 12, since the circumferential groove 73 does not communicate with the discharge passage 51, the leak of the pilot fluid by the air removing circuit 76 is blocked.

Also, when the control valve V is switched from the neutral position 23 to the second switch position 25, the spool 45 moves rightward from the neutral position 23, the second pilot chamber 57B and the discharge passage 51 communicate with each other via the air removing circuit 76 in the other end portion 48B of the control valve V in the axial direction, and the pilot fluid led into the second pilot chamber 57B partially leaks to the discharge passage 51 via the air removing circuit 76. Also, the leak of the pilot fluid by the air removing circuit 76 is blocked in the one end portion 48A of the control valve V in the axial direction.

The action when the control valve V is switched to the second switch position 25 is similar to the action when the control valve V is switched to the first switch position 24, and hence the description thereof will be omitted.

Meanwhile, for example, when the pilot fluid led into the pilot chamber 57 is partially leaked only by the spiral groove 67 without the circumferential groove 73 and the axial groove 72, air is likely to remain in the pilot chamber 57. Specifically, describing with reference to FIG. 10, air in the pilot chamber 57 tends to remain in a portion above a height position H1 of the end portion 67*b* (an inlet-side end portion of the pilot fluid) located in the outer portion (near the pilot chamber 57) of the spiral groove 67 in the spool axial direction. Further, since the spool 45 is rotatable on the axis, for example, when the spool 45 is assembled, the height of the inlet-side end portion 67*b* of the spiral groove 67 varies depending on the rotational position of the spool 45 on the axis. When the height of the inlet-side end portion 67*b* of the spiral groove 67 is lower than the position indicated in FIG. 10, air is further less likely to be removed. As described above, the amount of air remaining in the pilot chamber 57 (air removal amount) varies only by the spiral groove 67, and switching responsiveness of the spool 45 is not stable.

Also, if the pilot fluid in the pilot chamber 57 is leaked by causing the first space 69 and the discharge passage 51 to communicate with each other only by the axial groove 72 without the spiral groove 67, the leak amount of the pilot fluid is likely to be excessive.

In contrast, in the present embodiment, the axial groove 72 and the spiral groove 67 are used in combination, and hence air in the pilot chamber 57 can be stably removed while the leak amount of the pilot fluid is reduced. Specifically, in the present embodiment, the leak amount of the pilot fluid is determined by the passage resistances of the axial groove 72 and the spiral groove 67 from the first space 69 to the circumferential groove 73 and the passage resistance of the spiral groove 67 from the circumferential groove 73 to the discharge passage 51. That is, by causing the circumferential groove 73 and the discharge passage 51 to communicate with each other by the spiral groove 67, it is possible to reduce the leak amount of the pilot fluid by increasing the passage resistance compared to a case where the axial groove 72 causes the circumferential groove 73 and the discharge passage 51 to communicate with each other (a case where the axial groove 72 causes the pilot chamber 57 and the discharge passage 51 to communicate with each other). Also, although air tends to accumulate in an upper portion of the pilot chamber 57, the pilot fluid in the pilot chamber 57 is leaked from the axial groove 72 located above the spool 45, that is, the pilot fluid is leaked from a high position in the pilot chamber 57, so that air in the pilot fluid led into the pilot chamber 57 can be properly removed, and the amount of air remaining in the pilot chamber 57 can be reduced. Also, since the position of the axial groove 72 does not change, air can be stably removed regardless of the rotational position of the spool 45 on the axis. Thus, since the leak amount of the pilot fluid is restricted by the spiral groove 67, the leak amount of the pilot fluid is also reduced, and air in the pilot chamber 57 can be stably removed.

As described above, by using the axial groove 72 and the spiral groove 67 in combination to remove air from inside the pilot chamber 57, air inside the pilot chamber 57 can be stably removed while the leak amount of the pilot fluid is reduced.

Also, the throttle 81 of the air removing circuit 76 corresponds to a portion of the spiral groove 67 from the circumferential groove 73 to the discharge passage 51. Specifically, a range H2 (see FIGS. 10 and 11) of the spiral groove 67 between an end portion of the circumferential groove 73 near the discharge passage 51 and an end portion of the discharge passage 51 near the circumferential groove 73 is a portion corresponding to the throttle 81. If the circumferential groove 73 is not provided, the length of the spiral groove 67 in the portion corresponding to the throttle 81 changes depending on the rotational position of the spool 45 on the axis, and the portion corresponding to the throttle 81 becomes unstable. Thus, since the circumferential groove 73 is provided, the portion corresponding to the throttle 81 can be stable.

Note that, when the axial groove 72 is machined, the circumferential groove 73 is machined first, and then the axial groove 72 is machined using a tool. Thus, the circumferential groove 73 is also necessary for machining the axial groove 72.

In the above embodiment, the example is provided in which the single axial groove 72 is formed in the spool hole 47 in each of the one end portion 48A and the other end portion 48B of the spool hole 47 in the spool axial direction. However, this does not imply any limitation, and a plurality of axial grooves 72 may be formed around the spool 45 (a plurality of axial grooves 72 may be formed at intervals in the circumferential direction of the spool hole 47). Accordingly, when the control valve V (control valve unit CV) is mounted in the working machine 1 (machine body 2), the orientation of the control valve V (control valve unit CV) can be selected from a plurality of orientations according to the mounting situation, and versatility of installation of the control valve V (control valve unit CV) can be enhanced. Specifically, for example, by forming an axial groove 72 additionally below the spool 45 in FIG. 4 (for example, at a position at which the angle between the axial grooves 72 with respect to the axis of the spool 45 is 180 degrees), the control valve V can be installed such that the axial groove 72 is located above the spool 45 when the control valve V is installed with a lower surface of the control valve V in FIG. 4 facing upward. Also, by forming an axial groove 72 additionally on the near side of the spool 45 in FIG. 4 (for example, at a position at which the angle between the axial grooves 72 with respect to the axis of the spool 45 is 90 degrees), the control valve V can be installed such that the axial groove 72 is located above the spool 45 when the control valve V is installed with a surface of the control valve V on the near side in FIG. 4 facing upward. Also, by forming an axial groove 72 additionally on the far side of the spool 45 in FIG. 4 (for example, at a position at which the angle between the axial grooves 72 with respect to the axis of the spool 45 is 90 degrees), the control valve V can be installed such that the axial groove 72 is located above the spool 45 when the control valve V is installed with a surface of the control valve V on the far side in FIG. 4 facing upward. Note that the positions of the axial grooves 72 in the case where the plurality of axial grooves 72 are provided around the spool 45 are merely examples, and this does not imply any limitation.

Also, in the above embodiment, the air removing circuit 76 is provided in each of both the one end portion 48A and the other end portion 48B in the spool axial direction. However, this does not imply any limitation, and the air removing circuit 76 may be provided in only one of the one end portion 48A and the other end portion 48B in the spool axial direction.

Also, in the present embodiment, the pilot-operation switching valve is exemplified as the control valve V. However, this does not imply any limitation, and a pilot type proportional solenoid valve may be employed as the control valve V. The pilot type proportional solenoid valve is a valve that controls the direction and flow rate of the flow of the hydraulic fluid by moving the spool 45 with a pilot control pressure controlled by a proportional solenoid. Specifically, the pilot type proportional solenoid valve is a two-stage direction/flow-rate control valve in which a proportional solenoid pressure reducing valve including two proportional solenoids is used as a pilot portion. The flow rate is controlled by changing input current to the proportional solenoids, and the direction is controlled depending on which one of the two proportional solenoids is applied with current.

Alternatively, a pair of proportional solenoid valves formed separately from the control valve V may be provided, the pilot control pressure may be supplied from one of the proportional solenoid valves to the first pressure receiver 42A, and the pilot control pressure may be supplied from the other proportional solenoid valve to the second pressure receiver 42B, thereby controlling the flow direction and the flow rate of the hydraulic fluid to the hydraulic actuator AC (MT, ML, MR, C1 to C5) of the control valve V.

Also, in the present embodiment, the spiral groove 67 is provided from the position communicating with the discharge passage 51 to the position communicating with the pilot chamber 57. However, this does not imply any limitation, and the spiral groove 67 may be provided at least from the discharge passage 51 to the position communicating with the circumferential groove 73.

Also, in the present embodiment, the configuration has been described in which the pilot chamber 57 and the discharge passage 51 are blocked from each other when the spool 45 is in the neutral position 23. However, this does not imply any limitation, and a configuration in which the pilot chamber 57 and the discharge passage 51 communicate with each other via the axial groove 72 and the spiral groove 67 when the spool 45 is in the neutral position 23 may be employed.

A control valve V according to the present embodiment includes a valve body 46; a spool hole 47 formed in the valve body 46; a spool 45 slidably fitted in the spool hole 47; a pilot chamber 57 into which a pilot fluid to actuate the spool 45 is led; a discharge passage 51 to discharge a hydraulic fluid to an outside of the valve body 46; a spiral groove 67 to communicate with the discharge passage 51, the spiral groove 67 being formed in a spiral shape on an outer periphery of the spool 45; and at least one axial groove 72 to cause the pilot chamber 57 and the spiral groove 67 to communicate with each other, the axial groove 72 being formed along an axial direction of the spool 45 on an inner surface of the spool hole 47.

According to this configuration, the spiral groove 67 communicates with the discharge passage 51, and the pilot chamber 57 communicates with the spiral groove 67 via the axial groove 72, so that the pilot fluid in the pilot chamber 57 leaks from the spiral groove 67 to the discharge passage 51 via the axial groove 72, and air is removed. That is, since the pilot fluid leaks from the spiral groove 67 via the axial groove 72 formed in the valve body 46, air can be stably removed regardless of the rotational position of the spool 45 on the axis.

Additionally, the pilot chamber 57 is adjacent to the spool hole 47 in the axial direction of the spool 45, and the axial groove 72 is located above the spool 45, in a state in which the valve body 46 is installed such that the spool 45 extends in a horizontal direction.

According to this configuration, since air can be removed from a high position in the pilot chamber 57, the amount of air remaining in the pilot chamber 57 can be reduced.

Additionally, the at least one axial groove 72 includes a plurality of axial grooves 72 formed around the spool 45.

According to this configuration, the orientation of the control valve V can be selected from a plurality of orientations according to the mounting situation, and versatility of installation of the control valve V can be enhanced.

Additionally, a passage resistance of the spiral groove 67 is larger than a passage resistance of the axial groove 72.

According to this configuration, since the pilot fluid flowing from the pilot chamber 57 to the axial groove 72 is restricted by the spiral groove 67 and flows to the discharge passage 51, air in the pilot chamber 57 can be stably removed while the leak amount of the pilot fluid is reduced.

Additionally, the control valve V includes a circumferential groove 73 formed in a circumferential direction on the inner surface of the spool hole 47, the circumferential groove 73 communicating with an end portion of the axial groove 72 opposite to an end portion of the axial groove 72 that communicates with the pilot chamber 57. The discharge passage 51 is located opposite to the axial groove 72 with respect to the circumferential groove 73 to be spaced apart from the circumferential groove 73, and the spiral groove 67 causes the circumferential groove 73 and the discharge passage 51 to communicate with each other.

According to this configuration, the pilot fluid led into the pilot chamber 57 flows from the axial groove 72 to the circumferential groove 73, and flows from the circumferential groove 73 to the discharge passage 51 via the spiral groove 67. A portion of the spiral groove 67 between the circumferential groove 73 and the discharge passage 51 constitutes a throttle 81 that restricts the amount of pilot fluid leaking to the discharge passage 51. Thus, if the circumferential groove 73 is not provided, the length of the spiral groove 67 of the portion corresponding to the throttle 81 changes depending on the rotational position on the axis of the spool 45, and the portion corresponding to the throttle 81 becomes unstable. However, since the circumferential groove 73 is provided, the portion corresponding to the throttle 81 can be stable.

Additionally, the pilot chamber 57 and the discharge passage 51 are blocked from each other when the spool 45 is in a neutral position 23, and the pilot chamber 57 and the discharge passage 51 communicate with each other via the axial groove 72 and the spiral groove 67 when the spool 45 is moved by a predetermined amount from the neutral position 23 with the pilot fluid led into the pilot chamber 57. According to this configuration, the leak amount of the pilot fluid when the spool 45 is in the neutral position 23 can be reduced.

Additionally, a working machine 1 according to the present embodiment includes the above-described control valve V. Thus, air in the pilot chamber can be properly removed regardless of the mounting situation of the control valve V, the posture of the working machine 1, or the like.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A control valve comprising:

a valve body;

a spool hole formed in the valve body;

a spool slidably fitted in the spool hole;

a pilot chamber into which a pilot fluid to actuate the spool is led;

a discharge passage to discharge a hydraulic fluid to an outside of the valve body;

a spiral groove formed in a spiral shape on an outer periphery of the spool;

at least one axial groove to cause the pilot chamber and the spiral groove to communicate with each other, the axial groove being formed along an axial direction of the spool on an inner surface of the spool hole; and a circumferential groove formed in a circumferential direction on the inner surface of the spool hole, the circumferential groove communicating with an end portion of the axial groove opposite to an end portion of the axial groove that communicates with the pilot chamber, wherein the discharge passage is located opposite to the axial groove with respect to the circumferential groove to be spaced apart from the circumferential groove, the pilot chamber is adjacent to the spool hole in the axial direction of the spool, and the axial groove is located above the spool, in a state in which the valve body is installed such that the spool extends in a horizontal direction, and the spiral groove is configured such that:

when the spool is in a neutral position, the spiral groove is located closer to the pilot chamber than the axial groove is to the pilot chamber; and when the spool is moved by a predetermined amount from the neutral position by the pilot fluid led into the pilot chamber, the spiral groove causes the pilot chamber and the discharge passage to communicate with each other bypassing the axial groove and the circumferential groove and the spiral groove directly communicates with the axial groove and the circumferential groove.

2. The control valve according to claim 1, wherein the at least one axial groove includes a plurality of axial grooves formed around the spool.

3. The control valve according to claim 1, wherein a passage resistance of the spiral groove is larger than a passage resistance of the axial groove.

4. A working machine comprising the control valve according to claim 1.

* * * * *